United States Patent [19]

Seibel

[11] 4,416,354

[45] Nov. 22, 1983

[54] ROTARY FEEDTHRU CONTROL

[75] Inventor: David Seibel, Lakeville, Minn.

[73] Assignee: The Perkin-Elmer Corporation, Norwalk, Conn.

[21] Appl. No.: 279,413

[22] Filed: Jul. 1, 1981

[51] Int. Cl.[3] ..... G05G 5/06

[52] U.S. Cl. ..... 188/166; 74/503; 74/545; 192/95; 414/1

[58] Field of Search ..... 188/67, 80, 166, 325, 188/343; 414/1, 8; 74/503, 545, 554; 192/7, 95

[56] References Cited

U.S. PATENT DOCUMENTS

| | | | |
|---|---|---|---|
| 1,398,262 | 11/1921 | Gray | 74/503 X |
| 1,878,333 | 9/1932 | Scott | 188/166 X |
| 2,841,034 | 7/1958 | Greene | 74/545 X |
| 3,190,416 | 6/1965 | Harter | 192/95 |
| 3,625,378 | 12/1971 | Attiz | 414/8 |
| 4,030,615 | 6/1977 | Guggi | 414/8 |
| 4,036,079 | 7/1977 | Pratt | 74/554 X |
| 4,201,096 | 5/1980 | Morrison et al. | 188/166 X |

FOREIGN PATENT DOCUMENTS

| | | | |
|---|---|---|---|
| 55-119545 | 9/1980 | Japan | 188/166 |

*Primary Examiner*—Leslie J. Paperner

*Attorney, Agent, or Firm*—S. A. Giarratana; F. L. Masselle; R. A. Hays

[57] ABSTRACT

A mechanism for providing for the one-handed control of a rotary feedthru includes bi-directional braking means which is controllable by the same element used for imparting rotation to the feedthru.

6 Claims, 4 Drawing Figures

ROTARY FEEDTHRU CONTROL

BACKGROUND OF THE INVENTION

The present invention generally related to a rotary feedthru control mechanism and, in particular, relates to such a mechanism including braking means.

In general, rotary feedthru devices are most often employed to permit external access to enclosed ambients without any disruption or contamination of the enclosed ambient. One field which has benefited from rotary feedthru devices is the field of analytical instruments, specifically those instruments requiring the use of an ultra-high vacuum chamber, i.e. chambers having pressures on the order of about $10^{-7}$ torr. The benefit derives from the ability to move, manipulate or otherwise work on a sample material within such a chamber without breaking the vacuum. This is important, since considerable time is required to create, or restore, such a vacuum.

Present rotary feedthru devices, particularly, for example, those employed when the probe being controlled thereby is under a force moment, require both hands of the operator to operate the mechanism. That is, one hand is required to release the lock, or brake, and the other hand is required to hold the rotational portion so that the mechanism does not react in an uncontrolled fashion due to the presence of the force moment. Such a device is inconvenient, particularly when a single operator is required to either simultaneously operate two probes or is required to perform some single-handed task while manipulating the rotary feedthru mechanism.

Thus it is quite desirable to be able to operate a rotary feedthru mechanism with the use of only one hand.

SUMMARY OF THE INVENTION

Accordingly, it is one object of the present invention to provide a mechanism for single-handedly controlling a rotary feedthru mechanism.

This object is accomplished, at least in part, by a rotary feedthru mechanism having means for braking the movement of the mechanism integral with the means for rotating the feedthru mechanism.

Other objects and advantages will become apparent from the following detailed description and the appended drawing.

BRIEF DESCRIPTION OF THE DRAWING

A drawing, not drawn to scale, of a mechanism embodying the principles of the present invention includes.

DETAILED DESCRIPTION OF THE INVENTION

Figure 1:
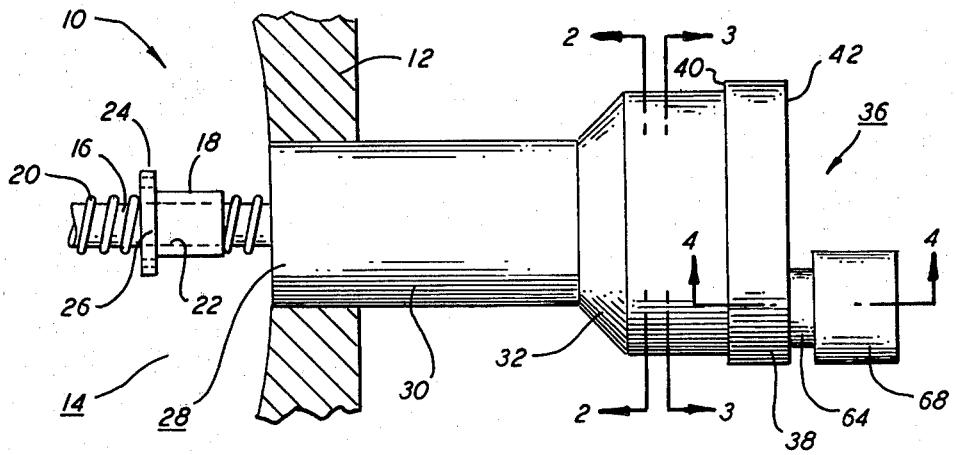
FIG. 1, which is a side view of a rotary feedthru mechanism.

A rotary feedthru mechanism, generally indicated by the numeral 10 in FIG. 1, embodying the principles of the present invention, extends through a side wall 12, shown in section in FIG. 1, of a chamber 14. In one particular embodiment, the chamber 14 is an ultra-high vacuum chamber of an analytical instrument.

The rotary feedthru mechanism 10 generally includes a rotatable shaft 16 having a fixture 18 cooperatively affixed thereto such that when the shaft 16 is rotated, the fixture 18 moves linearly along the length thereof. Alternatively, the fixture 18 can be a gear arrangement, or the like, attached to provide movement to a manipulator, for example. The desired movement of the fixture 18 can be accomplished by techniques well known in the art, one of the most common techniques being the provision of a spiral thread 20 on the shaft 16 meshing with a similar thread on a through-hole 22 in the fixture 18. Usually the fixture 18 includes a flange 24 at one end 26 thereof to which a probe, or manipulator or the like can be attached.

Figure 2:
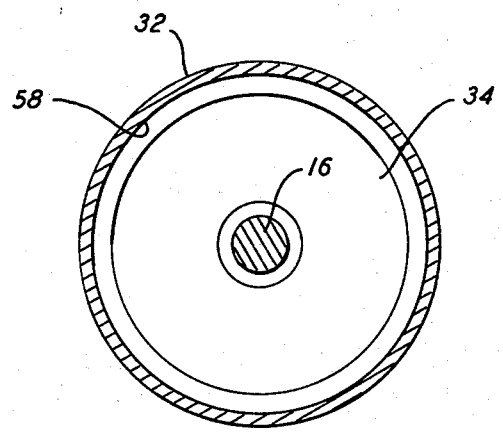
FIG. 2, which is a cross-sectional view of the mechanism shown in FIG. 1 taken along the line 2—2 thereof.

The rotatable shaft 16 passes through a housing 28 which includes a barrel portion 30 and a drum portion 32. Preferably, the shaft 16 is axially positioned through the housing 28 by a pair of bearings, not shown, at each end of the barrel portion 30. In addition, the barrel portion 30 usually includes a hermetic packing material or a bellows to ensure that the chamber 14 is hermetically sealed from the external ambient. In order to prevent linear motion of the shaft 16, a restrictor plate 34, shown in FIG. 2, is usually affixed to the shaft 16 within the drum portion 32 of the housing 28.

Figure 4:
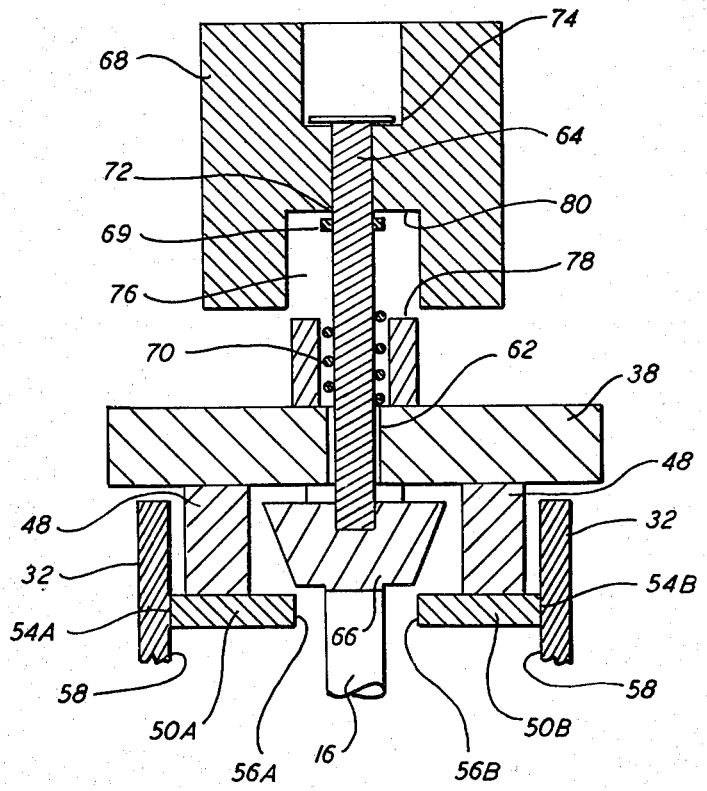
FIG. 4, which is an illustrative cross-sectional view of the mechanism shown in FIG. 1 taken along the line 4—4 thereof.
Figure 3:
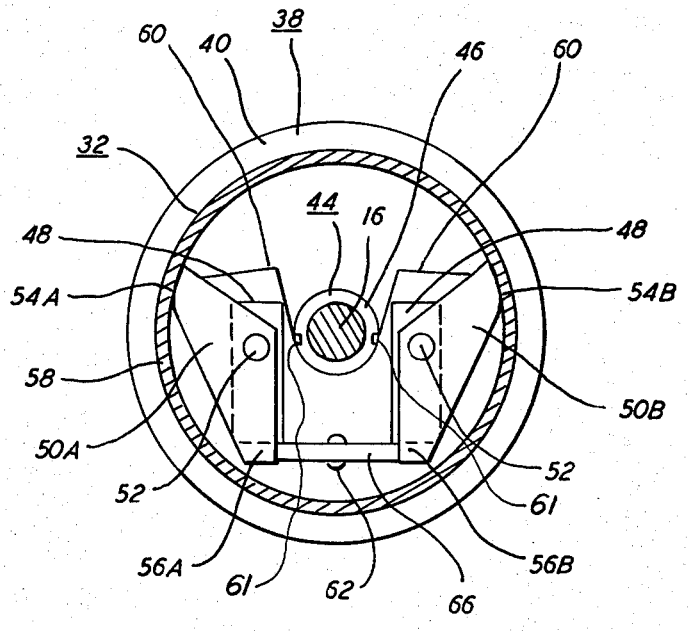
FIG. 3, which is a cross-sectional view of the mechanism shown in FIG. 1 taken along the line 3—3 thereof.

The rotation of the shaft 16 is directly responsive to a control means 36 rigidly affixed thereto at a point therealong distal from the barrel portion 30 of the housing 28 and external to the chamber 14. The control means 36 is especially designed to permit both rotation of the shaft 16 and braking control thereof by use of only one hand. One particular embodiment which accomplishes this design intent is described hereinafter with reference to FIGS. 3 and 4 of the drawing.

The control means 36 includes a carrier plate 38 having first and second major surfaces, 40 and 42, respectively. Preferably, the carrier plate 38 is a circular cylinder having the first and second surfaces, 40 and 42, respectively, substantially parallel to and opposing each other. In this embodiment, the first surface 40 of the plate 38 is proximate the drum portion 32 of the housing 28. The first surface 40 of the plate 38 preferably includes shaft attachment means 44 via which the plate 38 can be rigidly affixed to the rotatable shaft 16. The means 44 can be, for example, a threaded blind hole, a rim extension or other means well known in the art. Preferably, the means 44 is axially positioned on the plate 38. For reasons more fully discussed below, it is preferred that the means 44 include at least a rim 46 extending from the first surface 40 and sized to accept the shaft 16 therewithin. The first surface 40 of the plate 38 is also provided with a pair of brake shoe mounting blocks 48. The blocks 48, in the preferred embodiment, are rectangularly shaped and extend into the drum portion 32 of the housing 28 when the control plate 38 is mounted to the shaft 16. Although a pair of blocks 48 have been shown and described, a suitably arranged single brake shoe mounting block could also be used. The blocks 48 or block can also be provided via an integral machined protrusion of plate 38.

A pair of brake shoes 50 are pivotably mounted to the blocks 48 by pivot pins 52. Each brake shoe, 50A or 50B, of the pair of shoes 50, includes a brake surface, 54A and 54B, respectively, and a release pressure surface, 56A and 56B, respectively. In the brake mode, the brake surface, 54A or 54B, of each shoe, 50A or 50B, respectively, is urged against the inner wall 58 of the drum portion 32 by urging means 60. In one embodiment, the urging means 60 is a pair of springs retained in place at one end thereof by grooves 61 in the rim attachment means 44. The other end of each spring is permitted to ride on the edge of the respective shoe, 50A or 50B. Preferably, the brake shoes 50A and 50B are arranged so that each shoe 50A and 50B applies brake pressure to the inner wall 58 in a direction of opposite rotation to the other shoe 50B or 50A. Hence, the shoes 50A and 50B together provide bi-directional rotational braking. For each shoe, 50A or 50B, the release pressure surface, 56A or 56B, respectively, is so located that when pressure is applied thereto, the respective shoe, 50A or 50B, pivots around the pivot pin 52 thereof to remove the brake shoe surface, 54A or 54B, respectively from the inner wall 58 of the drum portion 38, thereby freeing the shaft 16 for rotation.

The carrier plate 38 includes an aperture 62 therethrough, which aperture 62 is eccentric from the axis of the carrier plate 38. A brake release rod 64 passes through the aperture 62. The brake release rod 64 has a brake shoe pressure wedge 66 affixed to the end thereof proximate the drum portion 32 and a knob 68 affixed to the other end thereof. Preferably, the aperture 62 is so located that the wedge 66 is aligned with the release pressure surfaces, 56A and 56B, of the brake shoes, 50A and 50B, respectively.

In the preferred embodiment, the wedge 66 is trapezoidal in cross-section with the smaller major surface of the trapezoid being proximate the brake shoes 50. Hence, when the wedge 66 is urged toward the shoes 50, via pressure applied to the knob 68, it contacts the release pressure surfaces 56A and 56B. In the preferred embodiment, retainer 69, such as a spring clip or the like, is provided on the rod 64 whereby pressure applied to the knob 68 is translated to the rod 64 for movement thereof. The force applied to the surfaces 56A and 56B by the wedge 66 is translated into a pivoting force to separate the brake surfaces, 54A and 54B, from the inner wall 58, thus permitting rotation of the shaft 16. Upon removal of the pressure applied to the knob 68, the wedge 66 is retracted from the shoes 58 by a bias means 70, which in the preferred embodiment, is a coil spring located about the rod 64 between the knob 68 and the second major surface 42 of the carrier plate 38.

In practice, the brake release rod 64 is affixed to the knob 68 through bearings 72 and 74, which arrangement enables the knob 68 to rotate freely about the release rod 64. Thus, when the knob 68 is depressed and shaft 16 is rotated, the rotation can be accomplished by "palming" the knob 68. Since the knob 68 can be depressed to pivot the brake shoes 50, the entire operation can be carried out by use of a single hand. That is, for example, to rotate the shaft 16, the knob 68 is depressed to pivot the brake shoes 50 and, with the knob 68 depressed, the shaft 16 is rotated by "palming" the knob 68.

In order to prevent frictional forces from being created between the knob 68 and the carrier plate 38 at surface 42 during the rotation of the shaft 16, the knob 68 is preferably provided with a cavity 76 and the plate 38 is provided with a cylinder 78. The cylinder 78 is rigidly affixed to the plate 38 and dimensioned so as to fit around the means 70 and within the cavity 76. The cavity 76 extends into the knob 68 a distance such that, when fully depressed, the cylinder 78 contacts the bottom 80 thereof to ensure that the knob 68 remains slightly spaced apart from the surface 42 of the carrier plate 38.

Although the present invention has been described in detail with reference to a specific embodiment, other arrangements can be developed without departing from the spirit and scope hereof. Hence, the description herein is considered exemplary and is not to be construed as limiting. The present invention is deemed limited only by the claims appended hereto and the reasonable interpretation thereof.

What is claimed is:

1. A mechanism for controlling an ultra-high vacuum rotary feedthru, said mechanism comprising:

a rotatable shaft;

a brake drum extending around said shaft and coaxial therewith;

a carrier plate affixed to said shaft; said carrier plate having at least one carrier block associated therewith;

at least one brake shoe pivotably affixed to said carrier block and spaced apart from said carrier plate thereby; and means for moving said brake shoe between a first position, whereat said brake shoe applies, via a biassing means, a frictional force against said drum thereby preventing movement of said carrier plate, and a second position, whereat said brake shoe is spaced apart from said drum thereby permitting rotation of said carrier plate, said moving means including a wedge affixed to a pressure rod eccentric with respect to said rotatability, said wedge being so positioned that upon the urging of said rod, said wedge pivots said brake shoe, against said biassing means, from said first position to said second position.

2. Mechanism as claimed in claim 1 wherein said means further includes a control knob affixed to said pressure rod.

3. Mechanism as claimed in claim 2 wherein said knob is affixed to said rod via at least one bearing whereby said knob can rotate about said pressure rod.

4. Mechanism as claimed in claim 2 wherein said wedge is biased away from said brake shoes.

5. Mechanism as claimed in claim 4 wherein said wedge biasing means is a coil spring about said pressure rod and extending between said knob and said carrier plate.

6. Mechanism as claimed in claim 5 wherein said pressure rod extends through an aperture in said carrier plate, said aperture being eccentric from the axis of said carrier plate.

* * * * *